US006053136A

United States Patent [19]

Albanello et al.

[11] Patent Number: 6,053,136

[45] Date of Patent: Apr. 25, 2000

[54] TO INTERNAL COMBUSTION ENGINES WITH VARIABLE VALVE ACTUATION

[75] Inventors: Stefano Albanello; Francesco Vattaneo; Lorentino Macor, all of Orbassano, Italy

[73] Assignee: C.R.F. Societa Consortile per Azioni, Orbassano, Italy

[21] Appl. No.: 09/235,307

[22] Filed: Jan. 22, 1999

[30] Foreign Application Priority Data

Jan. 23, 1998 [IT] Italy ..... TO98A0060

[51] Int. Cl.[7] ..... F01L 13/00; F01L 1/46

[52] U.S. Cl. ..... 123/90.16; 123/90.12

[58] Field of Search ..... 123/90.12, 90.13, 123/90.15, 90.16

[56] References Cited

U.S. PATENT DOCUMENTS 4,671,221 6/1987 Geringer et al. ..... 123/90.16
4,674,451 6/1987 Rembold et al. ..... 123/90.16
4,930,465 6/1990 Wakeman et al. ..... 123/90.12
5,127,375 7/1992 Bowman et al. ..... 123/90.12
5,263,441 11/1993 Rembold et al. ..... 123/90.12
5,694,893 12/1997 Chan et al. ..... 123/90.12
5,746,175 5/1998 Hu ..... 123/322
5,839,400 11/1998 Vattaneo et al. ..... 123/90.16

*Primary Examiner*—Weilun Lo
*Attorney, Agent, or Firm*—Sughrue, Mion, Zinn, Macpeak & Seas, PLLC

[57] ABSTRACT

A variable valve actuating system for an internal combustion engine includes an auxiliary pressure accumulator having a one-way type of operation, provided with pawl-like stop means to hold a piston at a position reached due to an increase of pressure within the chamber of the accumulators, against the action of return spring means. When the engine is started, the stop means are deactivated.

3 Claims, 3 Drawing Sheets

TO INTERNAL COMBUSTION ENGINES WITH VARIABLE VALVE ACTUATION

Figure 1:
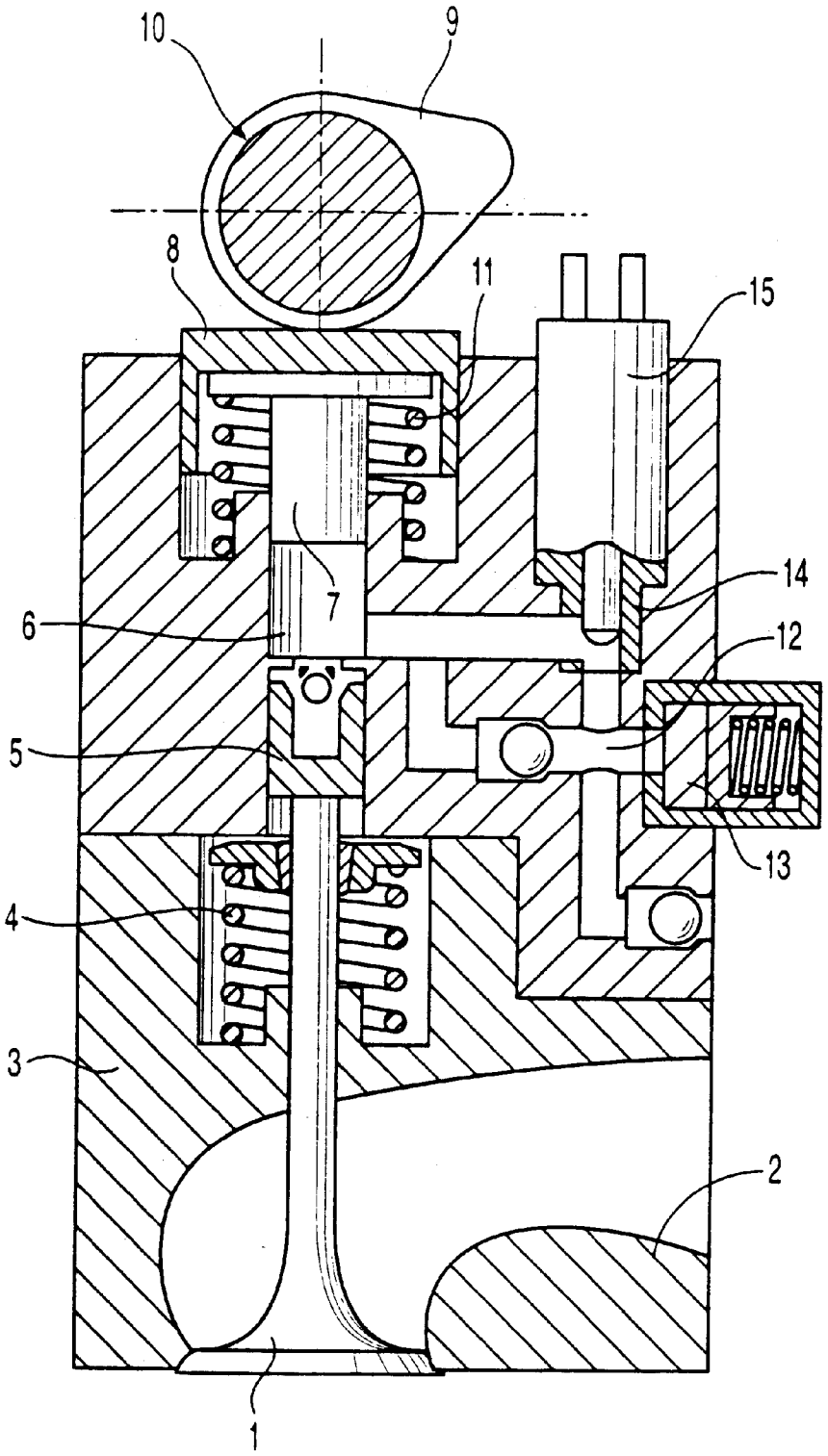

The present invention relates to internal combustion engines, of the known type comprising:

at least one intake valve and at least one exhaust valve for each cylinder, each provided with respective spring means for returning the valve towards the closed position, for controlling communication of the respective intake and exhaust conduits with the cylinder, a camshaft, for actuating the intake and exhaust valves of the engine cylinders by means of respective tappets, each intake valve and each exhaust valve being driven by a cam of said camshaft, wherein at least one of said tappets is adapted to drive the respective intake or exhaust valve, against the action of said return spring means, with the interposition of hydraulic means including a chamber of fluid under pressure, said chamber of fluid under pressure being adapted to be connected by a solenoid valve to an outlet channel, to uncouple the valve from the respective tappet thus causing the quick closing of the valve under the action of the respective return spring means, electronic control means for each solenoid valve, for varying the timing and opening travel of the respective valve as a function of one or more parameters of operation of the engine, and a pressure accumulator communicating with said chamber under pressure.

An engine of the above indicated type is disclosed for example in European patent application EP-A-0 803 640 of the same Applicant.

The above described system provides a variable control of the opening of the intake and exhaust valves, without altering the mechanical parts which control the displacement of the valves. In fact, while in a conventional timing system the movement of each intake or exhaust valve is univocally determined by the geometry of the mechanical parts which drive the valve (cam, tappet and rocker arm if this is provided), in the above described known system the solenoid valve controlling the chamber under pressure associated with a given valve can be driven to open at any time this is desired, so as to empty the above mentioned chamber of oil under pressure thus causing the quick closing of the intake or exhaust valve, under the action of the respective return spring means, even during a stage in which the respective cam would tend to keep the valve opened.

However, studies and tests conducted by the Applicant have shown that the engines of the above indicated type which have been made heretofore may have some drawback in operation, above all during the starting stage of the engine. These drawbacks are due to that the oil under pressure sent to the above mentioned chamber forming part of the variable valve actuating system is normally fed by the pump of the engine lubrication circuit. When the engine is off, the pressure in the chamber decreases progressively down to the value of the ambient pressure. When the engine is started again, pressure is again sent to the above mentioned chamber, so as to re-establish the requested conditions for operation of the hydraulic valve actuating system. Naturally, there is the problem of ensuring that fluid under pressure is sent to the chamber as rapidly as possible. The provision of the above mentioned pressure accumulator does not solve this problem satisfactorily, since during stop of the engine also the pressure within this accumulator tends to decrease due to the inevitable oil leakages.

The object of the present invention is that of overcoming the above mentioned drawbacks.

In view of achieving this object, the invention provides an internal combustion engine having all the features indicated at the beginning of the present description and further characterized in that it comprises an auxiliary pressure accumulator, including:

a rigid casing, a piston movable within the rigid casing and defining a variable volume chamber connected to said outlet channel and said pressure chamber, spring means interposed between the piston and an end wall of the rigid casing and tending to push said piston towards a rest position in which the volume of said variable volume chamber is minimum, pawl-like stop means defining a number of subsequent stop positions at which the piston is held, as long as it is displaced against the action of said spring means due to the increase of pressure in the variable volume chamber, and means for deactivating said stop means when the engine is started, so as to cause said piston to rapidly return to its rest position, under the action of said spring means.

Due to the above mentioned features, the auxiliary pressure accumulator has a one-way type of operation, since its piston is able to displace when the variable volume chamber must expand due to an increase of pressure, but remains instead at the position reached if the pressure decreases again. Therefore, during the operation of the engine after a start, the piston of the auxiliary pressure accumulator is progressively displaced towards its position corresponding to the maximum volume of the accumulator chamber, as long as the pressure of the oil of the lubrication circuit increases until reaching its maximum (such as in the order of 4.5 bars). If the engine is switched off, the pressure in the auxiliary accumulator chamber decreases progressively again down to the ambient pressure, due to the inevitable oil leakages, but in spite of this the accumulator piston remains at the position corresponding to the maximum volume which the chamber of the accumulator has reached during the previous engine operation, since it is held there by the pawl-like stop means. When the engine is started again, said deactivating means cause the quick return of the piston of the accumulator to its rest position, under the action of the associated spring means, so as ensure that oil under pressure is promptly sent to the pressure chamber of the valve variable actuating system.

In a preferred embodiment, the above mentioned means for deactivating the pawl-like means include a solenoid.

Figure 2:
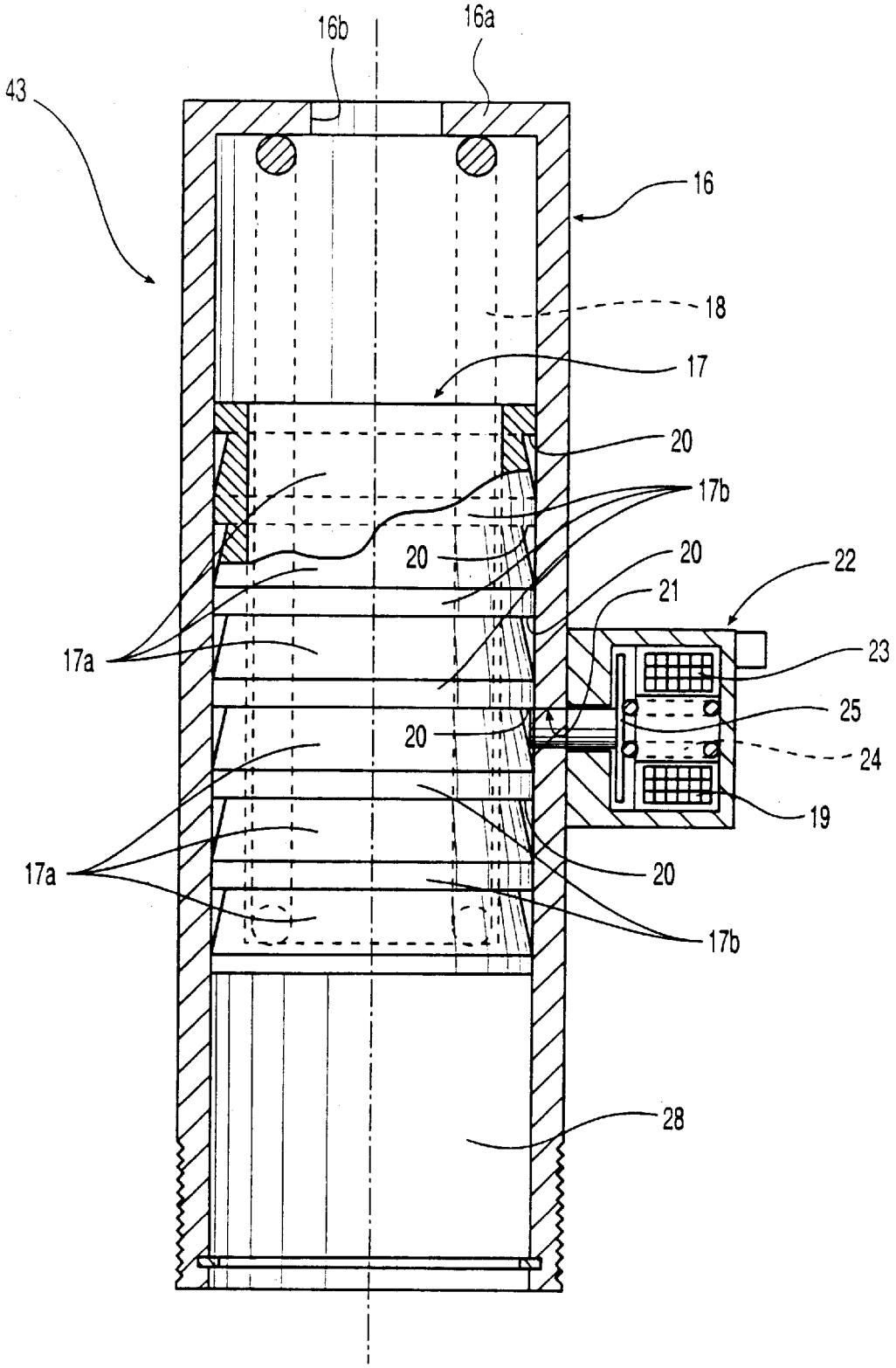
Figure 3:
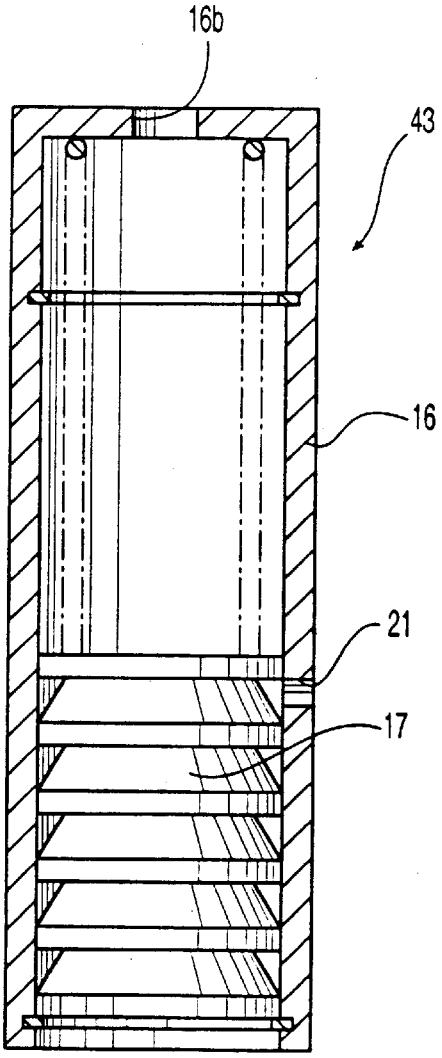
Figure 4:
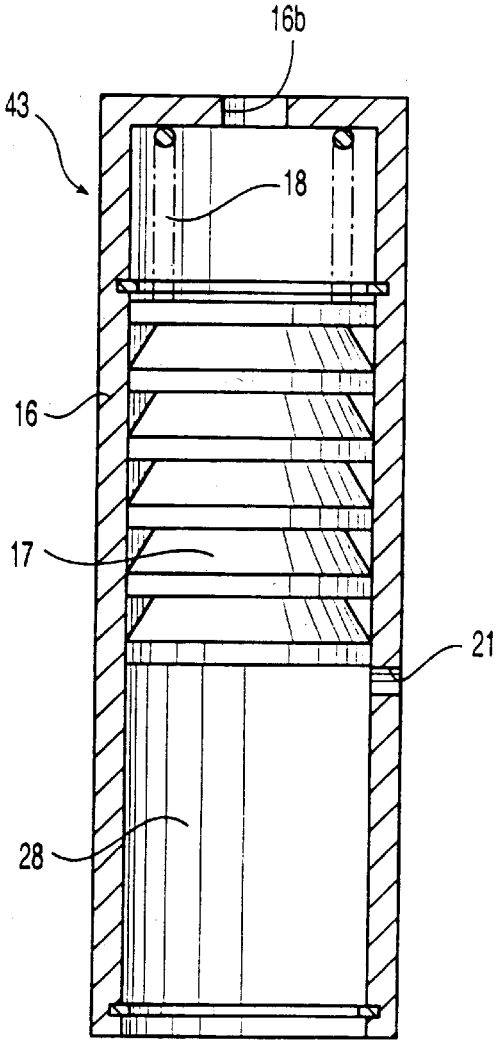

Further features and advantages of the invention will become apparent from the following description, with reference to the annexed drawings, given purely by way of non limiting example, in which:

FIG. 1 is a diagrammatic cross-sectional view of a variable actuating system for a valve of an internal combustion engine, according to the prior art, FIG. 2 is a diagrammatic cross-sectional view of a pressure accumulator forming part of the engine according to the invention, and FIGS. 3, 4 are cross-sectional views of the accumulator of FIG. 2 in two different conditions of operation.

FIG. 1 diagrammatically shows the principle of operation of a variable actuating system for a valve of an internal combustion engine according to the prior art. Reference numeral 1 generally designates the valve, which could be an intake valve or an exhaust valve, associated with a respective (intake or exhaust) conduit 2 formed in a cylinder head 3 of an internal combustion engine. The valve 1 is returned to its closing position (upwardly, with reference to FIG. 1) by a spring 4, while it is driven to open by a piston 5 pushing against the upper end of the valve stem. On its turn, piston 5 is driven with the interposition of oil under pressure filling chamber 6, by a piston 7 carrying a cup 8 cooperating with a cam 9 of a camshaft 10. The cup 8 is held by a spring 11 in sliding contact with cam 9. The pressure chamber 6 can be connected to a conduit 12, which communicates with a pressure accumulator 13, through the shutter 14 of a solenoid valve 15 which is driven by electronic control means (not shown) as a function of the conditions of operation of the engine. When the solenoid valve 15 is opened, the oil under pressure filling chamber 6 is discharged, so that the valve 1 is rapidly closed under the fact of its return spring 14.

When the solenoid valve 15 is closed, the oil filling chamber 6 transmits the movements of piston 7 to piston 5 and hence to valve 1, so that the position of valve 1 is determined by cam 9. In other words, the cam 9 normally drives the opening of valve 1 according to a cycle which depends from the cam profile. However, the cam can be "disabled" whenever this is desired by opening the solenoid valve 15, so as to brake the connection between the piston 7 and valve 1.

As already indicated above, in order to ensure prompt operation of the variable valve actuating system even during a starting stage of the engine, the engine according to the invention comprises an auxiliary accumulator 43 which is shown in FIG. 2. With reference to this figure, the accumulator 43 comprises a rigid casing 16 having a cylindrical shape, within which there is slidably mounted a piston 17 defining a variable volume chamber 28 communicated to a line for feeding oil under pressure (for example coming from the engine duplicating circuit) which communicates with all the channels 12 associated with the various cylinders of the engine. FIGS. 3, 4 show the same accumulator of FIG. 2 respectively in the condition of minimum volume and maximum volume of chamber 28. FIG. 2 shows the accumulator in a condition of intermediate volume of this chamber.

A spring 18 is axially interposed between the piston 17 and an end wall 16*a* of the casing 16, having a central bent aperture 16*b*.

When the piston 17 is moved upwardly (with reference to the drawings) following an increase of pressure within chamber 28, it reaches a number of subsequent stop positions due to the engagement of a pawl 19 against a plurality of shoulder annular surfaces 20 of piston 17, which are defined by a number of frusto-conical portions 17*a* of the piston which all converge in the same direction, and are alternated to cylindrical portions 17*b*. The pawl 19 is constituted by a pin which is slidably mounted within a radial hole 21 formed in the wall of the rigid casing 16 and through the body 22 of a solenoid actuator associated to the casing 16. The actuator 22 comprises a solenoid 23 which can be activated to return the pawl 19 towards a position disengaged from the piston 17, radially upwardly, against the action of a helical spring 24. The spring 24 is arranged within the body 22, between an end wall of the latter and a plate 25 secured to the base of pin 19.

During operation of the engine, as long as the pressure within the lubrication circuit increases until reaching its maximum value (such as about 4.5 bars) the piston 17 is progressively displaced upwardly (with reference to the drawings) against the action of spring 18 and is stopped at subsequent times at the various positions defined by the engagement of pawl 19 against a respective shoulder surface 20. Therefore, the piston 17 is moved progressively from the condition shown in FIG. 3 to the condition shown in FIG. 4, or until reaching a position intermediate therebetween, if the engine is switched off before the position shown in FIG. 4 is reached. At any case, when the engine is switched off and the pressure within chamber 28 decreases again, the piston 17 remains at the position reached, since it is held by the pawl 19. When the engine is started again, the starting operation causes the temporary actuation of solenoid 23 and the resulting unlocking of the piston 17 which returns rapidly to its rest position shown in FIG. 3, under the action of spring 18, thus ensuring the rapid return of fluid under pressure to the pressure chamber 6 of the variable valve actuating system.

Naturally, while the principle of the invention remains the same, the details of construction and the embodiments may widely vary with respect to what has been described and illustrated purely by way of example, without departing from the scope of the present invention.

For example, the shape of pawl 19, piston 17 and the way in which they cooperate with each other can be absolutely different from what has been illustrated purely by way of example. Same applies to the means able to deactivate the stop means of piston 17.

What is claimed is:

1. Internal combustion engine, comprising:

at least one intake valve and at least one exhaust valve for each cylinder, each provided with respective spring means returning the valve to its closed position, for controlling the communication between the respective intake and exhaust conduits and the cylinder, a camshaft, for actuating the intake and exhaust valves of the engine cylinders by means of respective tappets, each intake valve and each exhaust valve being driven by a cam of said camshaft, wherein at least one of said tappets is adapted to drive the respective intake or exhaust valve, against the action of said return spring means, with the interposition of hydraulic means including a chamber of fluid under pressure, said chamber of fluid under pressure being adapted to be connected by means of a solenoid valve to an outlet channel, for uncoupling the valve from the respective tappet thus causing the quick closing of the valve under the action of the respective return spring means, electronic control means for each solenoid valve, for varying timing and opening travel of the respective valve as a function of one or more parameters of operation of the engine, and a pressure accumulator communicating with said pressure chamber, wherein said engine comprises an auxiliary accumulator including:

a rigid casing, a piston movable within the rigid casing and defining a variable volume chamber connected to a line for supplying fluid under pressure to the outlet channels associated with the various cylinders, spring means interposed between the piston and an end wall of the rigid casing and tending to push said piston towards a position at which the volume of said variable volume chamber is minimum, pawl-like stop means defining a number of subsequent stop positions for said piston, at which the piston is held, as long as it is displaced against the action of said spring means due to the increase of pressure within the variable volume chamber, and means for deactivating said stop means when the engine is started, so as to cause the piston to rapidly return to its rest position, under the action of said spring means.

2. Engine according to claim 1, wherein said deactivating means include a solenoid.

3. Engine according to claim 1, wherein said piston has a number of frusto-conical portions, all converging in the same direction, alternated to cylindrical portions, so as to define a plurality of annular shoulder surfaces adapted to cooperate in sequence with a pawl which is slidably mounted within a radial hole of the rigid casing of the auxiliary accumulator, said pawl being pushed by spring means against said piston, said deactivating means being constituted by a solenoid adapted to return the pawl towards a position of disengagement from said piston.

* * * * *